US007311280B2

(12) United States Patent
Herren

(10) Patent No.: US 7,311,280 B2
(45) Date of Patent: Dec. 25, 2007

(54) ICE CRUSHER

(75) Inventor: Bruno Herren, Hergiswil (CH)

(73) Assignee: Moha Moderne Haushaltwaren AG, Zollikofen (CH)

( * ) Notice: Subject to any disclaimer, the term of this patent is extended or adjusted under 35 U.S.C. 154(b) by 233 days.

(21) Appl. No.: 10/534,180

(22) PCT Filed: Dec. 1, 2003

(86) PCT No.: PCT/CH03/00789

§ 371 (c)(1),
(2), (4) Date: May 5, 2005

(87) PCT Pub. No.: WO2004/063647

PCT Pub. Date: Jul. 29, 2004

(65) Prior Publication Data

US 2006/0108466 A1 May 25, 2006

(30) Foreign Application Priority Data

Jan. 15, 2003 (CH) ..... 0056/03

(51) Int. Cl.
*A47J 17/00* (2006.01)

(52) U.S. Cl. ..... 241/169; 241/272

(58) Field of Classification Search ..... 241/168, 241/169, 169.2, 272
See application file for complete search history.

(56) References Cited

U.S. PATENT DOCUMENTS 281,644 A 7/1883 Rex
2,046,396 A * 7/1936 Matter et al. ..... 241/84.4
2,056,097 A * 9/1936 Fegley et al. ..... 241/199.9
2,484,391 A 9/1947 Treiss, Jr.
3,587,692 A * 6/1971 Nelson ..... 241/270
3,933,315 A * 1/1976 Popeil ..... 241/166
4,417,512 A * 11/1983 Engelke ..... 100/266
4,479,719 A 10/1984 McCartney
4,967,970 A * 11/1990 Michel ..... 241/169
5,332,704 A 7/1994 Bartholic
5,632,450 A * 5/1997 Moor ..... 241/100
6,467,711 B2 * 10/2002 Michel ..... 241/169
2001/0028007 A1 * 10/2001 Michel ..... 241/169
2006/0154029 A1 * 7/2006 Antonini ..... 428/141

FOREIGN PATENT DOCUMENTS

WO WO 01/58652 A1 8/2001

* cited by examiner

*Primary Examiner*—Faye Francis
(74) *Attorney, Agent, or Firm*—Janet Sleath; Speckman Law Group PLLC

(57) ABSTRACT

A chopper, or crusher (1) for breaking up ice, including a housing (2, 3) able to be pushed over the goods to be broken up and with a knife (5) with a blade having a toothed cutter (52) is provided. An upper housing part (2) is detachably connectable to a beaker-like housing lower part (3) closed at the bottom. In a preferred embodiment, the height $H_K$ of the blade (51), the height of the beaker $H_B$ and the maximum vertical path of the knife (5) limited by an actuation mechanism (4) are selected and matched to one another such that the cutter (52) in its lowermost position does not come into contact with the beaker base (31).

11 Claims, 4 Drawing Sheets

ICE CRUSHER

FIELD OF THE INVENTION

The present invention relates to an ice crusher for chopping, crushing or breaking up ice and other frozen liquid foodstuffs.

BACKGROUND OF THE INVENTION

Onion and vegetable choppers are known from EP-B-0'345'223 and WO01/58652 of the applicant. They comprise a housing able to be pushed over the product to be broken up and a knife which is guided in the housing and which may be displaced against the force of a spring by means of an actuating mechanism comprising a push button and a plunger. The knife comprises a cylindrical axle or rod on whose lower end a plate-like knife holder is seated. On the lower side of the knife holder there are fastened one or more downwardly projecting blades which in a plan view are mostly wave-shaped or star-shaped. The knife may be displaced downwards against the force of the spring until the blade has completely penetrated the material to be chopped and abuts the base plate of the chopper. For the perfect functioning of all known choppers it is important that the lower cutters or cutting edges of the blades lie exactly in a horizontal plane.

Although such choppers are not designed for this, ice cubes are often cut up with known choppers in order to obtain finer pieces of ice for cocktails, drinks or for preparing foodstuffs. The chopping of ice may very easily blunt or bend the known blades. Bent blades jam very quickly with the scrapers, thereby significantly compromising the functioning ability of the chopper.

It is therefore the object of the invention to provide an apparatus which alleviates these disadvantages.

SUMMARY OF THE INVENTION

An ice crusher according to the present invention comprises a housing able to be pushed over the goods to be cut up and with an axle, or rod, which is guided in a housing upper part and which may be displaced downwards against the force of a spring by way of an actuating mechanism with a push button, wherein the axle at is lower end carries a knife provided with a toothed cutter.

BRIEF DESCRIPTION OF THE DRAWINGS

Hereinafter, embodiments of the invention are described by way of the accompanying drawings, in which:

FIG. 4*d* is a longitudinal section through the cutter according to FIG. 4*b*.

DETAILED DESCRIPTION

Figure 1:
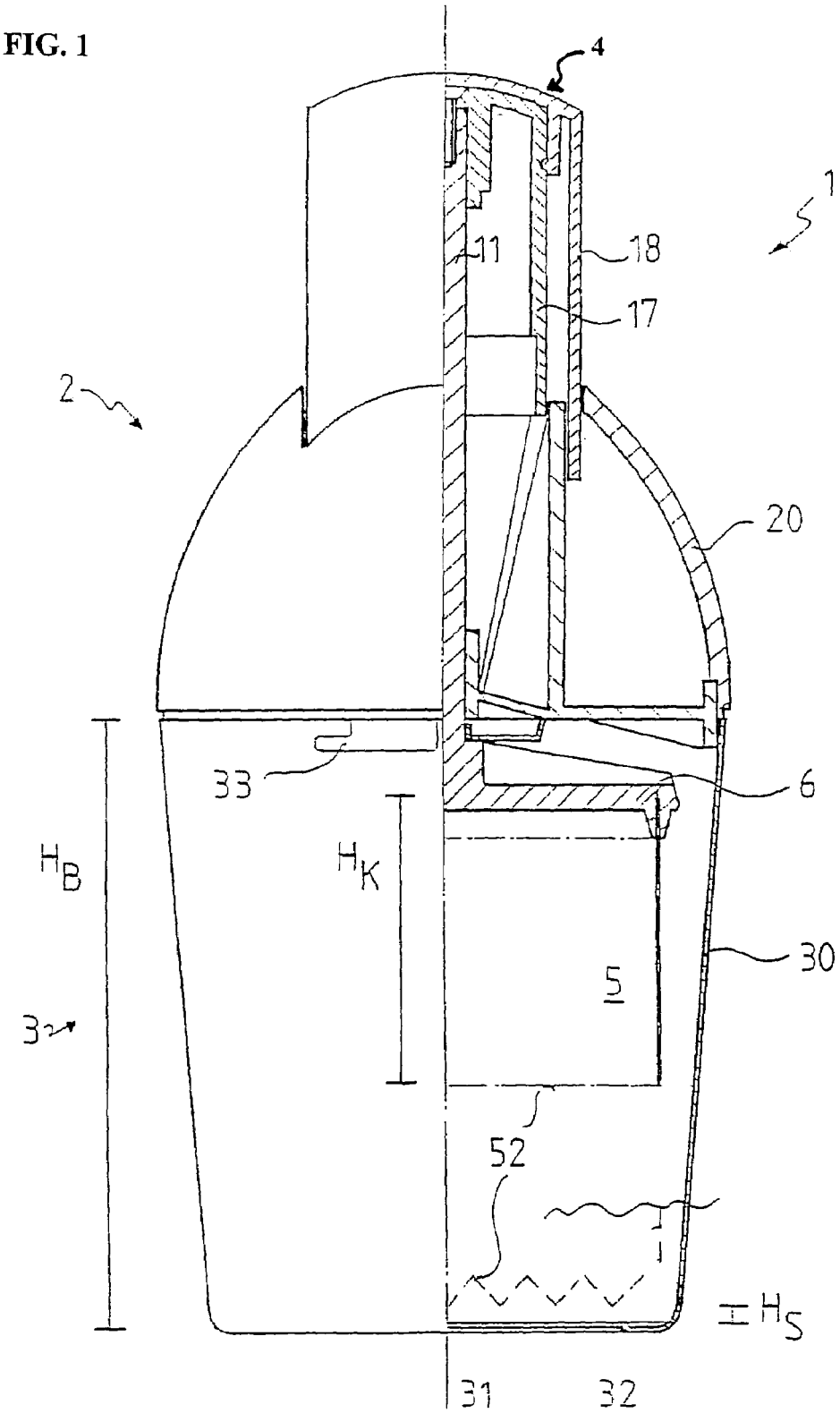
FIG. 1 is a partial longitudinal section through an ice crusher according to one embodiment of the invention.

The ice chopper, or crusher, shown in FIG. 1 comprises a housing 1 which consists of a multi-part upper part 2 and a preferably single-part lower part or beaker 3. The beaker 3 is connected to the upper part 2 by way of a bayonet closure 33 or similar device. Similar to the known onion and vegetable choppers, an actuation mechanism 4 is concentrically mounted and guided in the housing upper part 2. This mechanism comprises a push button 17 with a cap 18. In the housing upper part there is attached a knife 5 which may be displaced against the force of a spring by way of the actuation mechanism 4. The actuation mechanism 4 comprises a positive displacement mechanism which is known in the art and thus is not shown in detail in FIG. 1. The positive displacement mechanism ensures that with each to and fro movement the knife 5 rotates about its longitudinal axis by a certain angle. This rotation movement ensures that the knife does not chop on the same spot. In contrast to known vegetable choppers, the present ice chopper does not require a scraper which may be pushed over the knife.

The knife 5 comprises a cylindrical vertical axle or rod 11 on whose lower end there is seated a horizontally arranged carrier plate 6. On the lower side of the carrier plate 6 there are fastened one or more downwardly projecting blades 51 which in a plan view are mostly wave-shaped or star-shaped. The present invention may employ any previously known blade shapes. For reasons of cost, the vertical rod 11 and the carrier plate 6 are preferably manufactured as one piece by way of injection moulding, wherein one injects around the blade 51 in an upper region, whereby the blade 51 becomes nondetachably fastened to the carrier plate. In order to withstand the loading during chopping, the knife 5 is preferably manufactured of sturdy blade sheet metal of 0.3 to 0.5, more preferably 0.4 mm thickness D.

In a preferred embodiment of the present invention, shown in FIG. 1, the height $H_K$ of the blade 51, the height of the beaker $H_B$ and the maximal vertical path of the knife 5 limited by the actuation mechanism are selected and matched to one another such that the cutter 52 in its lowermost position does not come into contact with a beaker base 31. Thus in the lowermost knife position (in FIG. 1 shown dashed) there remains an air gap $H_S$ between the downwardly directed tips of teeth 53 of the cutter 52 and the base of the beaker 31.

As described below, the beaker fulfils a double function and is also used as a shaker lower part. In a preferred embodiment, it is therefore manufactured of stainless steel. The air gap $H_S$ prevents a direct abutment of the cutter 52 with the stainless steel base and thus prevents undesired blunting of the cutter and damage and scratching of the base 31. The height of the air gap $H_S$ is preferably between 1 and 7 mm, more preferably between 3 and 5 mm.

In a further embodiment which is not shown, the above-described beaker may be replaced by a cylindrical housing part open to the bottom. The height of the housing is again selected so that sensitive working surfaces are not contacted by the blades and will not be damaged on chopping.

With known choppers such an air gap is not desirable since it would lead to an unacceptable compromising of its functioning, however with the present ice chopper a complete penetration of the ice cubes to be chopped is not necessary. The ice cubes are broken apart by the sturdy blade 51, and do not need to be completely severed.

The breaking-apart effect of the blade is further encouraged by preferred designs of the blade. With the blade shown in FIGS. 4*a* and 4*c* the teeth are ground on both sides, wherein the cutting angle γ is preferably between 30 and 100°. With the blade shown in FIGS. 4*b* and 4*d* the teeth are ground on only one side and the cutting angle γ' is about 45°.

Figure 4A:
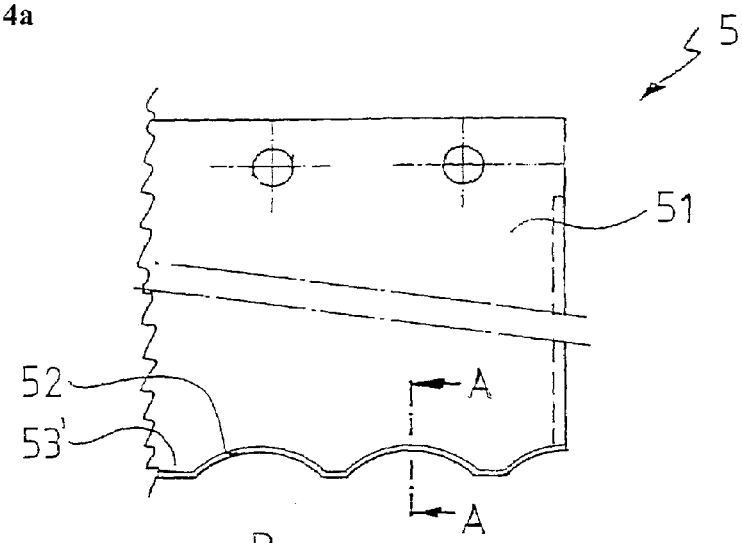
FIG. 4*a* is a partial view of a knife according to a preferred embodiment of the invention.
Figure 4B:
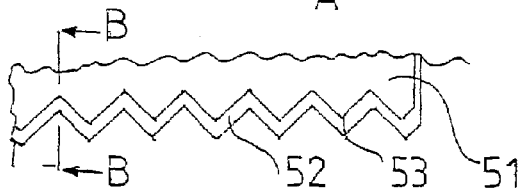
FIG. 4*b* is a partial view of a blade according to a further preferred embodiment of the invention.
Figure 4C:
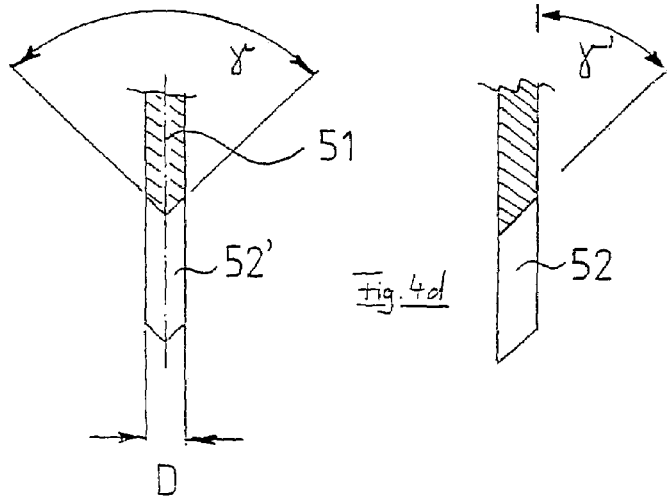
FIG. 4*c* is a longitudinal section through a cutter of a knife according to FIG. 4*a*.

The toothing of the blade may be selected according to the blade material and the manufacturing costs. Two possible tooth shapes are shown in FIGS. 4*a* and 4*b*. On chopping the hard and brittle ice cubes, the significant advantage of the toothed blades is that the teeth or the tips of the teeth simplify the penetration into the ice to be chopped.

In a further embodiment which is not shown, the teeth are bent alternately laterally out of the vertical plane of the blade and thereby reinforce the breaking-up effect of the ice chopper blade. The teeth may also be bent out of the vertical plane of the blade sheet metal twisted about their vertical axis so that the tips of the teeth still essentially lie in one plane and may penetrate the ice with relatively little resistance, and the breaking-up effect is enormously increased on further penetration due to the torsion of the teeth.

Figure 2B:
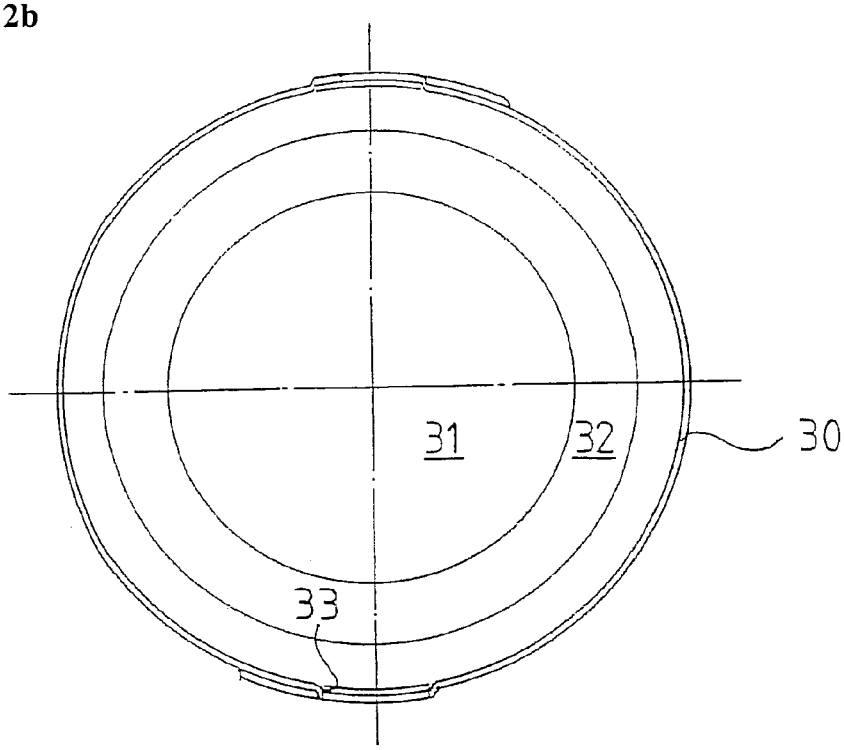
FIG. 2*b* is a view from above into a beaker according to FIG. 2*a;*
Figure 2A:
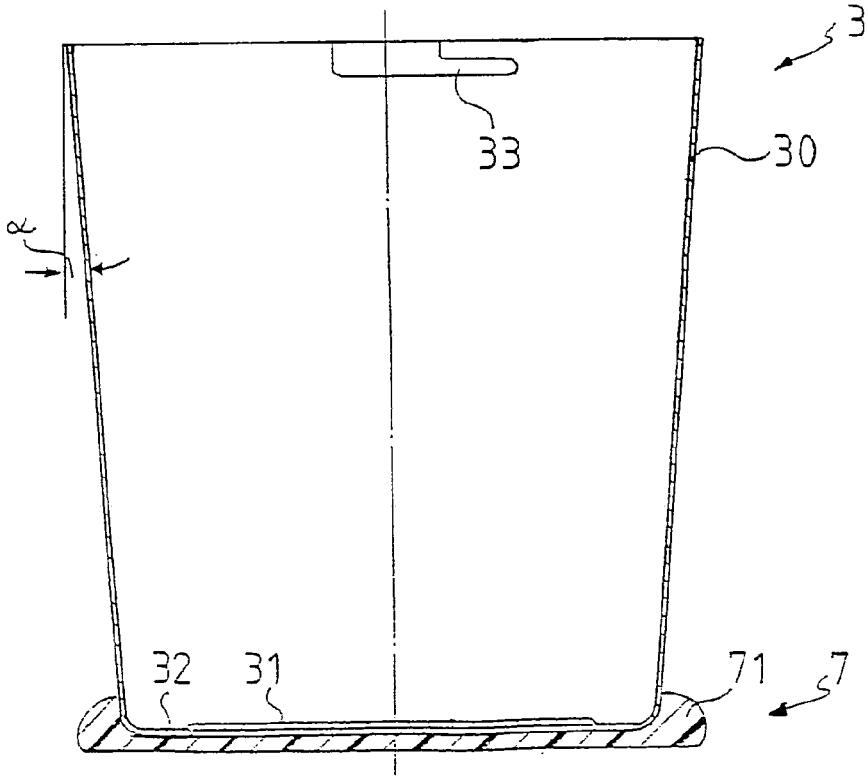
FIG. 2*a* is a longitudinal section through a beaker according to a preferred embodiment form of the invention.

FIG. 2*b* shows an underlay 7 adapted to the beaker, preferably of a soft elastomer such as silicone. The underlay 7 may be permanently or detachably connected to the beaker base 31 and/or to a circumferential peripheral stand ring 32. On chopping, the underlay 7 prevents the working surface from being scratched, damps the knocks and prevents the chopper 1 from slipping on a working surface. When the ice has been reduced to the desired size, the beaker 3 may be removed from the upper part 2 by means of the bayonet closure 33 and may be removed from the underlay by lifting, and the upper part 2 with the blade may be placed on the free underlay 7. The depositing of the knife 5 on the underlay 7 simultaneously protects both the cutter 52 and the working surface from damage. The underlay 7 preferably has a peripherally thickened circumferential edge bead 71 which prevents melted water which runs down or drips from the knife or other parts of the upper part 2, from running onto a working surface lying below this.

Figure 3A:
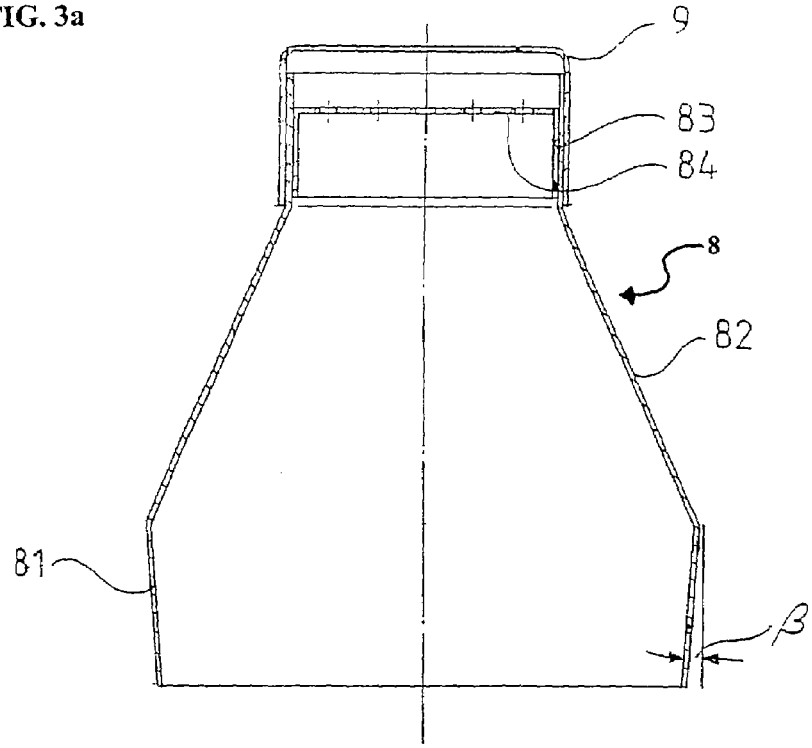
FIG. 3*a* is a longitudinal section through a shaker attachment with a lid.
Figure 3B:
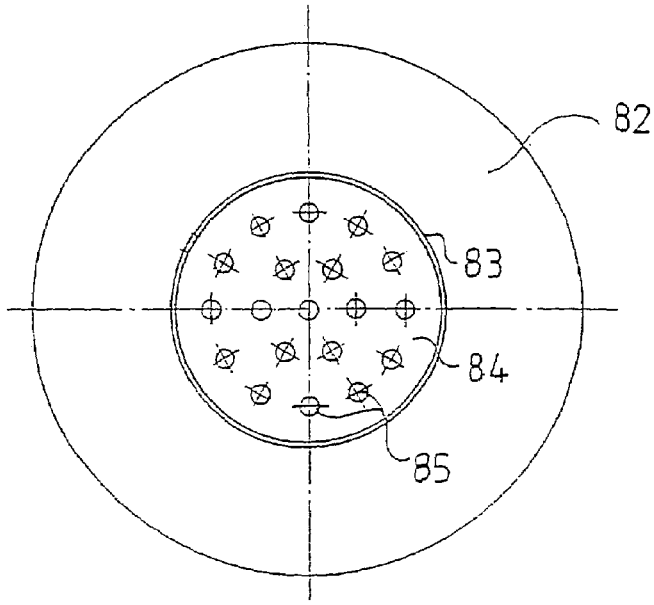
FIG. 3*b* is a view of the opened shaker attachment (without lid) according to FIG. 3*a*, from above.

The sidewall 30 of the beaker 30 widens to the top at an angle a so that with the upper part 2 removed one may fasten a fitting shaker attachment, or top, 8 in a clamped manner. The attachment, or top, 8, as shown in FIG. 3 has a sidewall 81 which tapers downwards at an angle β and which towards the top merges into the neck 83 via a cone 82. A sieve plate 84 with pour-out openings 85 is attached in the neck 83, and a lid 9 may be placed on for closure. The angles α and β are between 1 and 15°, preferably 4°. Angles α and β and the diameters of the upper beaker region and the lower attachment wall are matched to one another such that the attachment may be placed into the beaker approximately up to the transition of the wall 81 to the cone 82, thereby achieving an adequate sealing of the beaker to fluids.

The inner wall of the beaker is preferably provided with a grading in 10 decilitres and the shaker attachment lid 9 preferably has a volume capacity of 40 millilitres which is an important measure to barkeepers.

In order to meet the standards of hygiene required for use in the kitchen and bar region, the chopper upper part, beaker, shaker attachment and lid are manufactured of stainless steel, plastic suitable for foodstuffs, or a combination thereof depending on design and the price class.

LIST OF REFERENCE NUMERALS

1 ice chopper
2 housing upper part
3 beaker
4 actuating mechanism
5 knife
6 carrier plate
7 underlay
8 attachment
9 lid
11 axle
12 carrier plate
17 push button
18 cap
20 housing outer wall
30 beaker wall
31 beaker base
32 stand surface
33 bayonet closure
51 blade
52 cutter, 52' cutter
53 teeth, 53' teeth
71 edge bead
81 attachment wall
82 cone
83 neck
84 sieve plate
85 pour-out openings

I claim:

1. A hand-operated crusher for cutting up ice, comprising:

(a) a housing able to be placed over the ice to be cut up and comprising a removable upper part and a lower part, wherein the lower part has a closed lower, base, end;

(b) a vertical rod guided in the housing upper part, the rod being downwardly displaceable against the force of a spring by means of an actuating mechanism having a push button;

(c) a knife attached to the lower end of the vertical rod, the knife being provided with a toothed cutter at a lower edge, wherein the knife has a maximal vertical path that is limited by the actuating device and wherein the height of the knife, the height of the housing lower part and the maximal vertical path of the knife are selected such that the cutter, at its lowermost position, does not contact the base of housing lower part, whereby an air gap exists between a lower edge of the cutter and the base of housing lower part; and (d) a shaker attachment designed to detachably connect to the housing lower part in an essentially fluid-tight manner when the housing upper part is removed.

2. The crusher of claim 1, wherein the toothed cutter comprises teeth having a cutting angle of between 30 and 100°.

3. The crusher of claim 2, wherein the teeth are ground on one side and have a cutting angle of 45°.

4. The crusher of claim 2, wherein the teeth are ground on both sides and have a cutting angle of 90°.

5. The crusher of claim 1, further comprising an underlay adapted to the housing lower part.

6. The crusher of claim 5, wherein the underlay is manufactured of a soft, anti-slip elastomer.

7. The crusher of claim 6, wherein the underlay is manufactured of silicone.

8. The crusher of claim 5, wherein the underlay comprises a peripherally thickened circumferential edge bead.

9. The crusher of claim 1, wherein the housing lower part widens towards an upper region at an angle α and the shaker attachment comprises a sidewall which tapers towards a lower region at an angle β and merges into a cone at a top region, and wherein the diameter of the upper region of the housing lower part and the diameter of the lower region of the sidewall are matched to one another such that the shaker attachment may be inserted into the housing lower part approximately up to the transition of the sidewall into the cone thereby sealing the crusher to fluids.

10. The crusher of claim 9, wherein the angles $\alpha$ and $\beta$ are between 1° and 15°.

11. The crusher of claim 10, wherein the angles $\alpha$ and $\beta$ are 4°.

* * * * *